US007108480B2

(12) United States Patent
Zatorski et al.

(10) Patent No.: US 7,108,480 B2
(45) Date of Patent: Sep. 19, 2006

(54) METHOD AND APPARATUS FOR BALANCING TURBINE ROTORS

(75) Inventors: Darek Zatorski, Florence, KY (US); Marek Szrajer, Warszawa (PL); Leszek Rzeszutek, Warszawa (PL); John Edward Altman, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 83 days.

(21) Appl. No.: 10/857,234

(22) Filed: May 28, 2004

(65) Prior Publication Data

US 2005/0265845 A1 Dec. 1, 2005

(51) Int. Cl.
*F01D 5/10* (2006.01)

(52) U.S. Cl. ..... 415/119; 416/144

(58) Field of Classification Search ..... 416/114, 416/146 R, 144; 415/119
See application file for complete search history.

(56) References Cited

U.S. PATENT DOCUMENTS 2,610,823 A * 9/1952 Knowlton, Jr. ..... 416/190
5,011,374 A 4/1991 Miller
5,320,487 A 6/1994 Walker et al.
5,470,203 A * 11/1995 Mori et al. ..... 416/144
6,530,747 B1 * 3/2003 Schneider et al. ..... 416/144
2002/0085913 A1 * 7/2002 Bos ..... 415/209.4

* cited by examiner

*Primary Examiner*—Edward K. Look
*Assistant Examiner*—Nathan Wiehe
(74) *Attorney, Agent, or Firm*—William Scott Andes; Armstrong Teasdale LLP

(57) ABSTRACT

A method facilitates balancing a gas turbine rotor. The method includes providing a gas turbine rotor including a plurality of turbine blades, wherein at least one turbine blade includes a blade tip shroud that includes a leading edge and a trailing edge that is opposite the leading edge, and coupling a balance clip to the at least one turbine blade. The balance clip includes a first portion having a first length that enables the clip to extend between the tip shroud leading and trailing edges and includes a first hook that couples to the tip shroud leading edge, a shorter second portion that extends only partially from at least one of the tip shroud trailing and leading edges towards the opposite shroud edge, and a second hook that extends between the first and second portions and couples to at least one of the tip shroud leading and trailing edges.

19 Claims, 6 Drawing Sheets

METHOD AND APPARATUS FOR BALANCING TURBINE ROTORS

BACKGROUND OF THE INVENTION

This invention relates generally to gas turbine engines, and more specifically to methods and apparatus for assembling a gas turbine engine rotor.

Gas turbine engines generally include, in serial flow arrangement, a low pressure compressor and a high pressure compressor for compressing air flowing through the engine, a combustor in which fuel is mixed with the compressed air and ignited to form a high temperature gas stream, and a high pressure turbine. Moreover, at least one known gas turbine also includes a low pressure turbine that includes a plurality of stages, wherein each respective stage includes a row of stationary nozzle guide vanes that are mounted to a stationary turbine case, and a rotor which includes a plurality of circumferentially spaced rotor blades coupled to a rotatable turbine disk. At least some of the turbine rotors blades include a blade root that couples the rotor blade to the turbine disk and an airfoil that extends radially outwardly from the blade to a blade tip shroud.

During operation, the gas turbine engine may rotate at relatively high rotational speeds. Accordingly, proper balancing of the gas turbine rotors facilitates enhancing operation of the turbine engine, as even minor rotor imbalance may adversely affect the engine operation.

Accordingly, to facilitate balancing the turbine rotor at least one known gas turbine rotor assembly includes a substantially U-shaped clip coupled to at least one turbine rotor blade. However, assembling and installing the U-shaped clip may be time-consuming as the configuration of the clip may inhibit the coupling of the clip to the turbine rotor blade. More specifically, prior to installing the U-shaped clip, a technician must be trained on the installation process and following the installation, the turbine rotor may need to be inspected to ensure that each U-shaped clip was properly installed. Accordingly, the benefits gained in using such a clip may be outweighed by an increase in production costs and man power costs.

BRIEF DESCRIPTION OF THE INVENTION

In one aspect, a method for assembling a gas turbine rotor is provided. The method includes providing a gas turbine rotor including a plurality of turbine blades, wherein at least one turbine blade includes a blade tip shroud that extends from a leading edge to an opposite trailing edge, and coupling a balance clip to the at least one turbine blade. The balance clip includes a first portion having a first length that enables the clip to extend between the tip shroud leading and trailing edges and includes a first hook that is configured to couple to the tip shroud leading edge, a second portion having a second length that is shorter than the first length, such that the second portion extends only partially from at least one of the tip shroud trailing and leading edges towards the opposite shroud edge, and a second hook that extends between the first and second portions and is configured to couple to at least one of the tip shroud leading and trailing edges.

In another aspect, a balance clip for a gas turbine rotor is provided. The gas turbine rotor includes a plurality of turbine blades, wherein at least one turbine blade includes a blade tip shroud that extends from a leading edge to an opposite trailing edge. The balance clip includes a first portion having a first length that enables the balance clip to extend between the tip shroud leading and trailing edges and includes a first hook that is configured to couple to the tip shroud leading edge, a second portion having a second length that is shorter than the first length, such that the second portion extends only partially from at least one of the tip shroud trailing and leading edges towards an opposite shroud edge, and a second hook that extends between the first and second portions for coupling to at least one of the tip shroud leading and trailing edges.

In a further aspect, a gas turbine engine is provided. The gas turbine engine includes a turbine rotor assembly that includes a plurality of rotor blades; wherein at least one of the rotor blades includes a blade tip shroud that extends from a leading edge to an opposite trailing. The gas turbine engine also includes a balance clip that includes a first portion having a first length that enables the balance clip to extend between the tip shroud leading and trailing edges and includes a first hook that is configured to couple to the tip shroud leading edge, a second portion having a second length that is shorter than the first length, such that the second portion extends only partially from at least one of the tip shroud trailing and leading edges towards an opposite shroud edge, and a second hook that extends between the first and second portions and is configured to couple to at least one of the tip shroud leading and trailing edges.

DETAILED DESCRIPTION OF THE INVENTION

Figure 1:
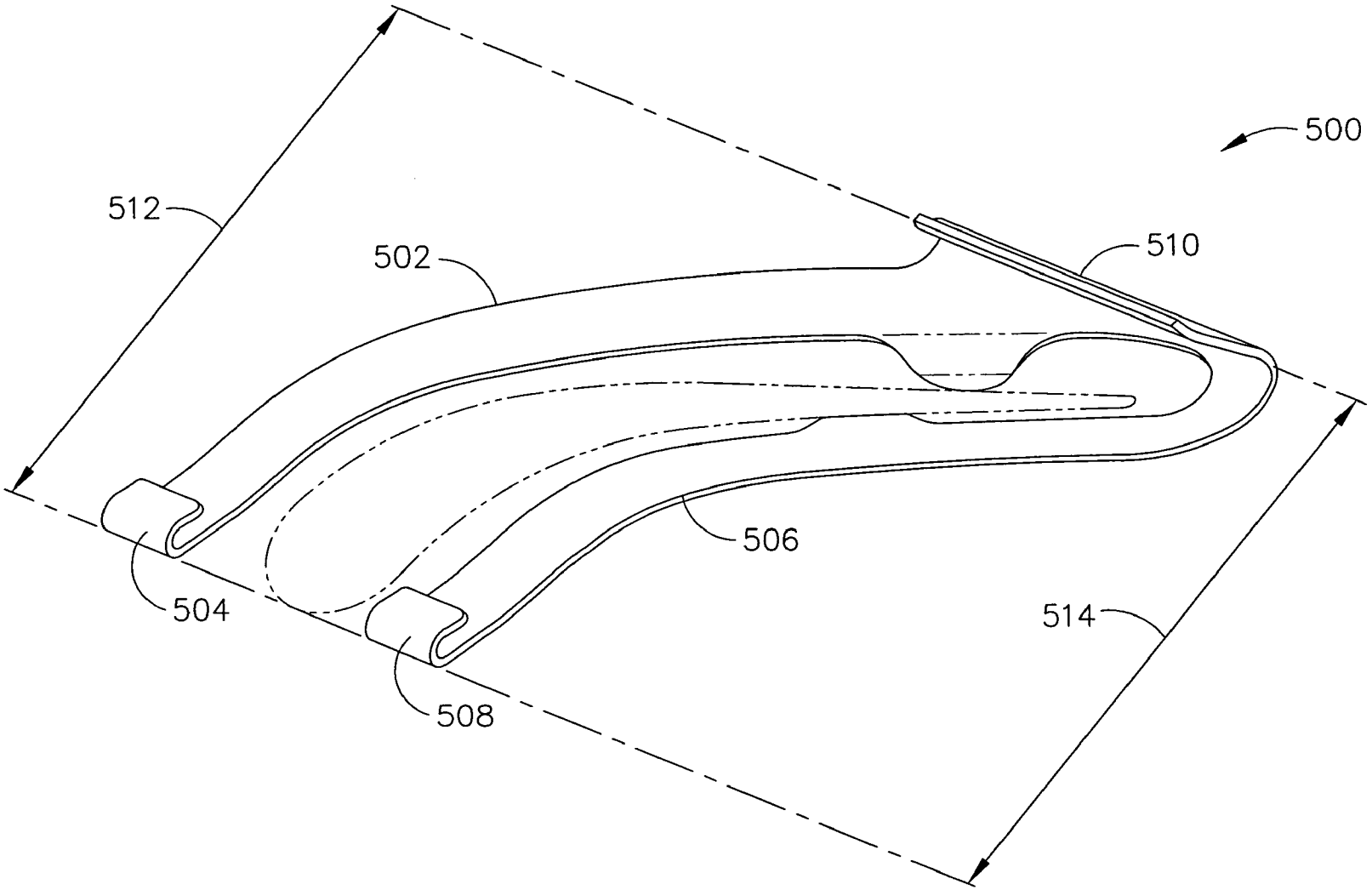
FIG. 1 (PRIOR ART)
FIG. 1 is a perspective view of an exemplary known balance clip.

FIG. 1 is a perspective view of an exemplary known balance clip 500. Balance clip 500 is substantially U-shaped and includes a first member 502 that has a first hook 504, and a second member 506 that has a second hook 508. Balance clip 500 also includes a third hook 510 that extends between first and second members 502 and 506. First and second members 502 and 506 respectively are formed unitarily together such that balance clip 500 at least partially circumscribes a turbine rotor blade (not shown). First member 502 has a length 512 and second member 506 has a length 514 that is substantially equivalent to length 512. Moreover, first hook 504 and second hook 508 enable clip 500 to couple to a periphery of a turbine rotor blade tip shroud (not shown in FIG. 1). However, during assembly, coupling balance clip 500 to the turbine rotor blade requires special tooling to ensure second hook 508 is correctly coupled to the turbine rotor blade tip shroud. More specifically, since length 512 is substantially equivalent to length 514, coupling second hook 508 to the turbine rotor blade requires the technician to use special tooling to connect second hook 508. Moreover, after second hook 508 is coupled to the turbine rotor blade an inspection is performed to ensure that balance clip 500 is correctly installed. Accordingly, special operator training and special tools are required to ensure that second hook 508 is correctly installed.

Figure 2:
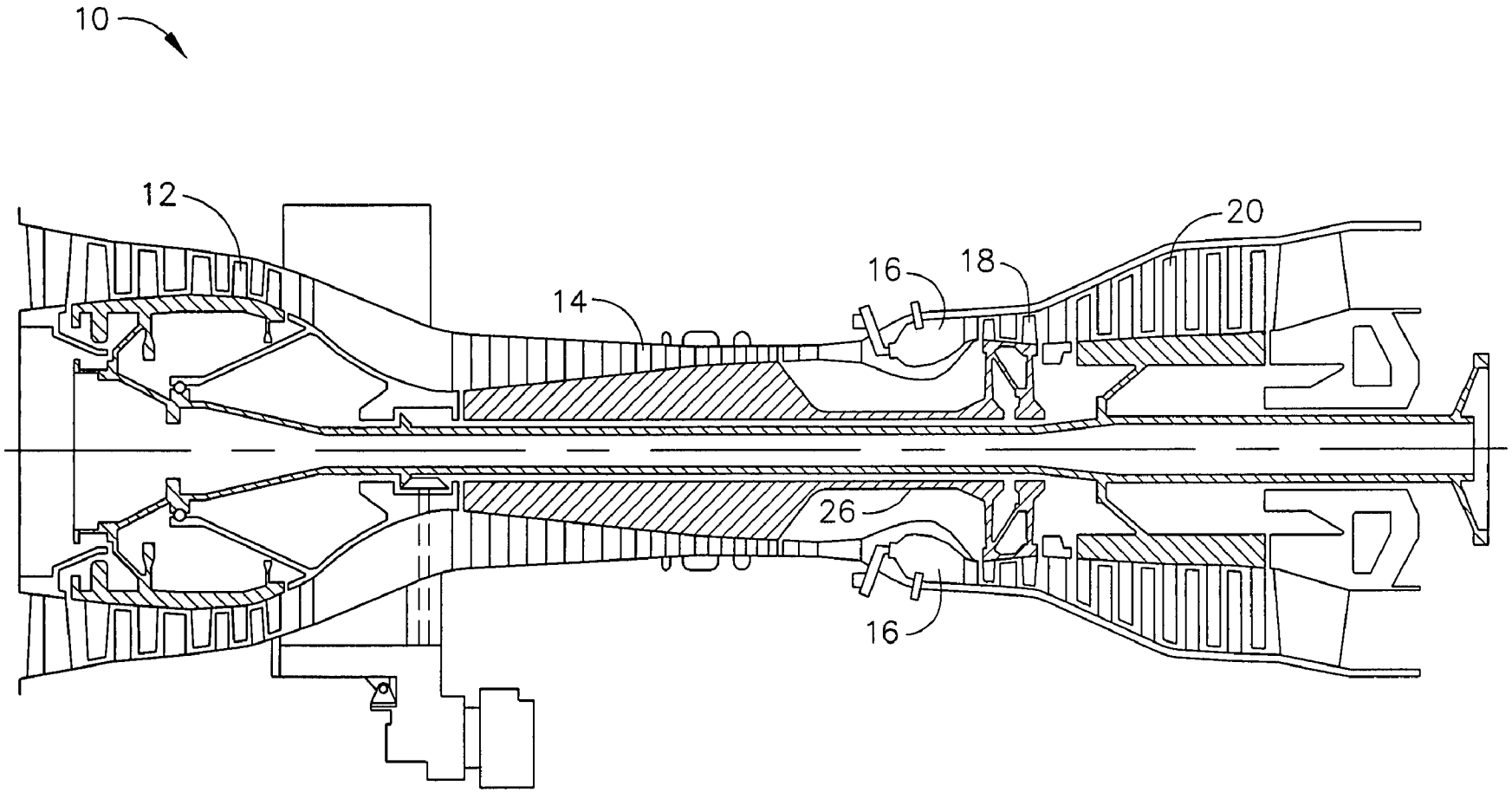
FIG. 2 is a perspective view of an exemplary gas turbine engine.

FIG. 2 is a schematic illustration of an exemplary gas turbine engine 10 including a low pressure compressor 12, a high pressure compressor 14, and a combustor 16. Engine 10 also includes a high pressure turbine 18 and a low pressure turbine 20.

In operation, air flows through low pressure compressor 12 and compressed air is supplied from low pressure compressor 12 to high pressure compressor 14. The highly compressed air is delivered to combustor 16. Airflow (not shown in FIG. 1) from combustor 16 drives turbines 18 and 20. In one embodiment, gas turbine engine 10 is a LM2500 engine available from General Electric Company, Cincinnati, Ohio. In another embodiment, gas turbine engine 10 is a LM6000 engine available from General Electric Company, Cincinnati, Ohio. In a further embodiment, gas turbine engine 10 is a LM1600 engine available from General Electric Company, Cincinnati, Ohio.

Figure 3:
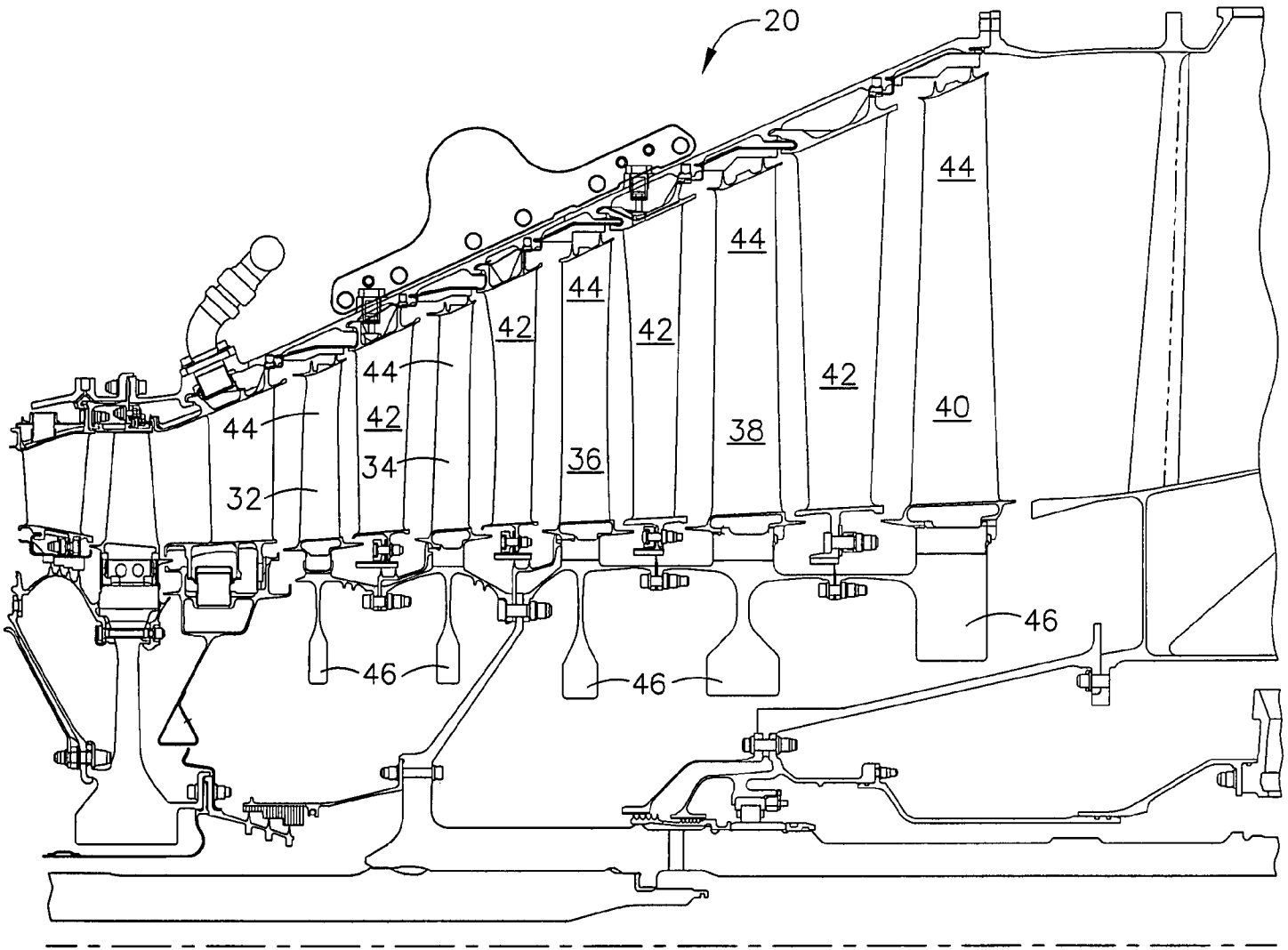
FIG. 3 is an enlarged cross-sectional view of a portion of the low pressure turbine shown in FIG. 2.

FIG. 3 is an enlarged cross-sectional view of a portion of low pressure turbine 20 (shown in FIG. 2). In the exemplary embodiment, low pressure turbine 20 includes five stages 30, wherein each stage 32, 34, 36, 38, and 40, respectively, includes a plurality of circumferentially-spaced stator vanes 42 and a plurality of circumferentially-spaced rotor blades 44, extending from a respective rotor disk 46.

Figure 4:
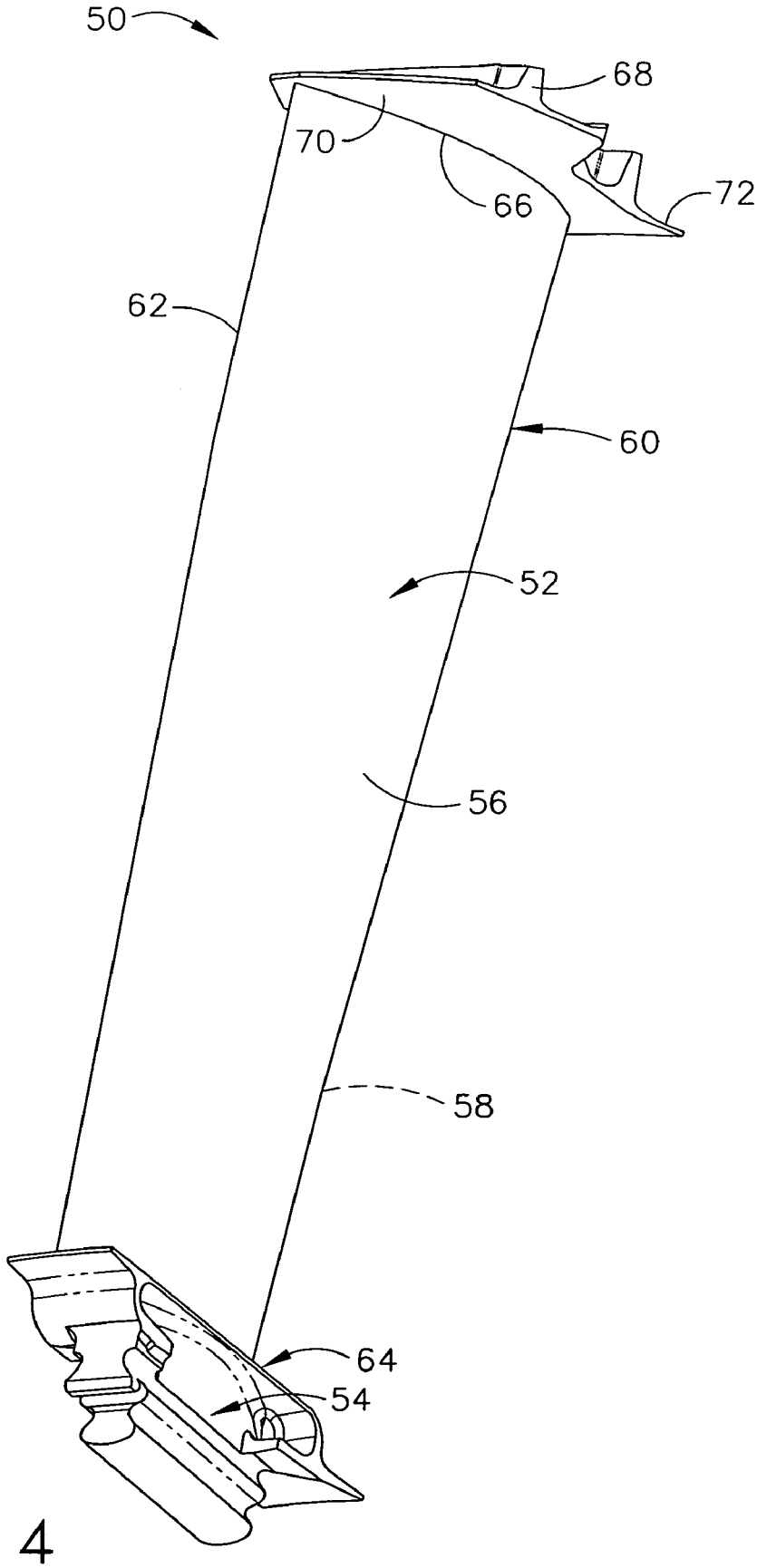
FIG. 4 is an enlarged perspective view of an exemplary rotor blade that may be used with the low pressure turbine shown in FIG. 3.

FIG. 4 is an enlarged perspective view of an exemplary rotor blade 50 that may be used with low pressure turbine 20. Each blade 50 includes an airfoil 52 and an integral dovetail 54 that is used for mounting blade 50 to a rotor disk, such as rotor disk 46 (shown in FIG. 3) in a known manner.

Each airfoil 52 includes a first contoured sidewall 56 and a second contoured sidewall 58. First sidewall 56 is convex and defines a suction side of airfoil 52, and second sidewall 58 is concave and defines a pressure side of airfoil 52. Sidewalls 56 and 58 are joined at a leading edge 60 and at an axially-spaced trailing edge 62 of airfoil 52. More specifically, airfoil trailing edge 62 is spaced chordwise and downstream from airfoil leading edge 60. First and second sidewalls 56 and 58, respectively, extend longitudinally or radially outward in span from a blade root 64 positioned adjacent dovetail 54, to an airfoil tip 66. In the exemplary embodiment, airfoil tip 66 includes a tip shroud 68 extending radially outward therefrom in a direction away from airfoil 52. Tip shroud 68 includes a bottom surface 70, an upper surface 72 that is configured to slidably contact a seal (not shown), leading edge 74, and a trailing edge 76.

Figure 5:
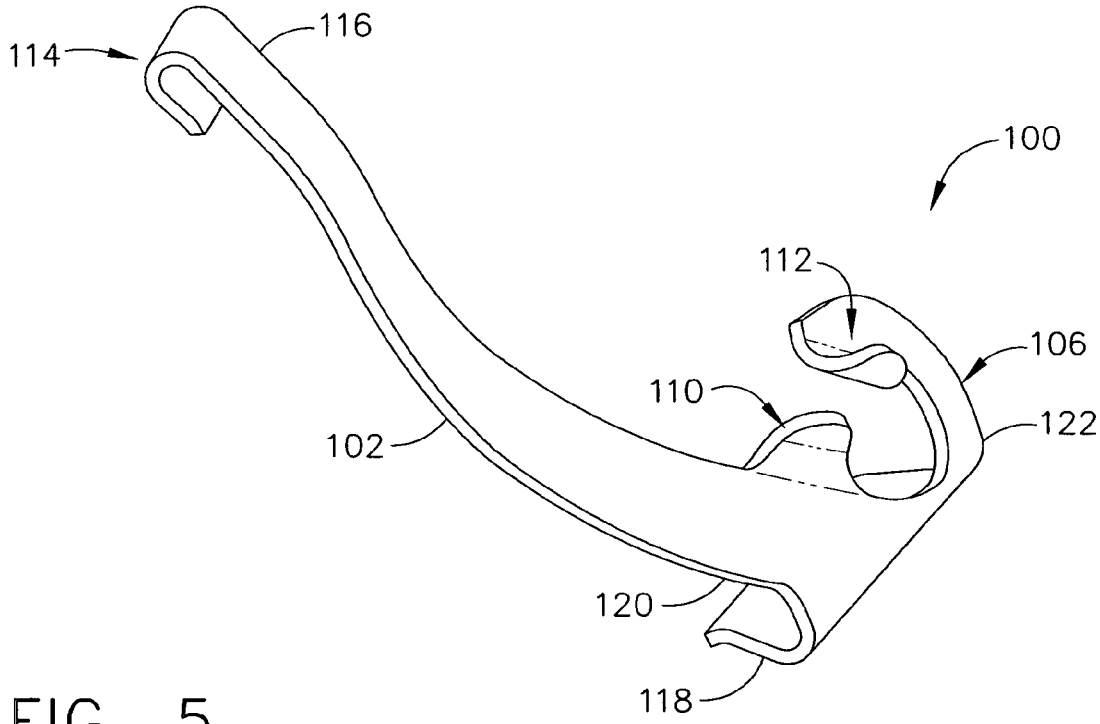
FIG. 5 is top perspective view of a balance clip.
Figure 6:
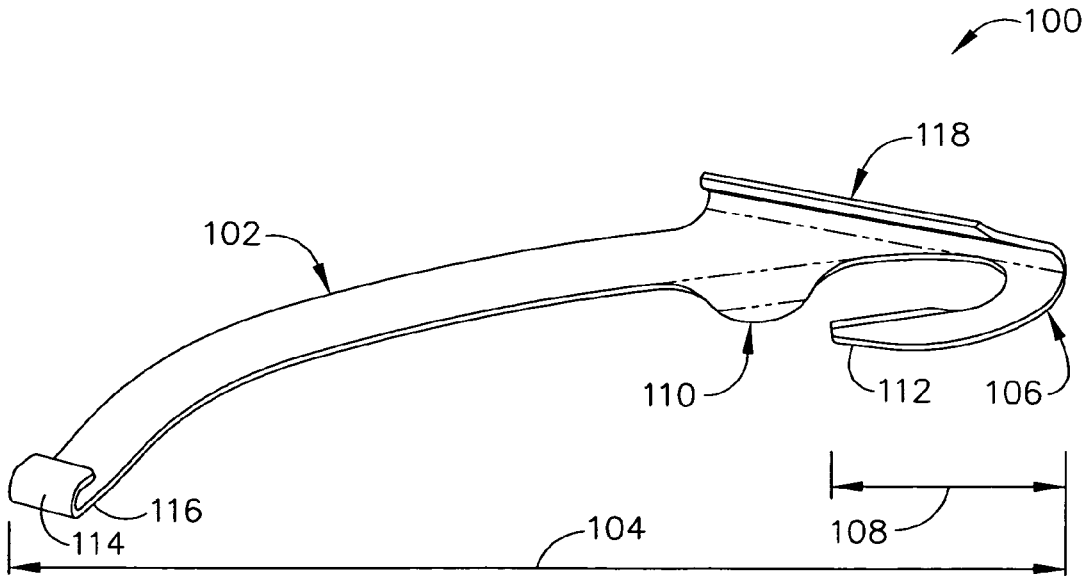
FIG. 6 is a bottom perspective view of the balance clip shown in FIG. 5.

FIG. 5 is top perspective view of a balance clip 100. FIG. 6 is a bottom perspective view of balance clip 100. In the exemplary embodiment, balance clip 100 is substantially L-shaped and includes a first portion 102 having a first length 104 and a second portion 106 having a second length 108 that is less than first length 104. First portion 102 includes a first tab 110 formed unitarily with first portion 102 and second portion 106 includes a second tab 112 formed unitarily with second portion 106. Balance clip 100 includes a first hook 114 that is coupled to a first end 116 of first portion 102 and a second hook 118 that is coupled to a second end 120 of first portion 102 and a first end 122 of second portion 106. In the exemplary embodiment, first portion 102, second portion 106, first tab 110, second tab 112, first hook 114, and second hook 118 are integrally formed together to form a unitary balance clip 100. In the exemplary embodiment, balance clip 100 is fabricated from a metallic material such as, but not limited to, Inconel 718 and/or AMS 5596.

Figure 7:
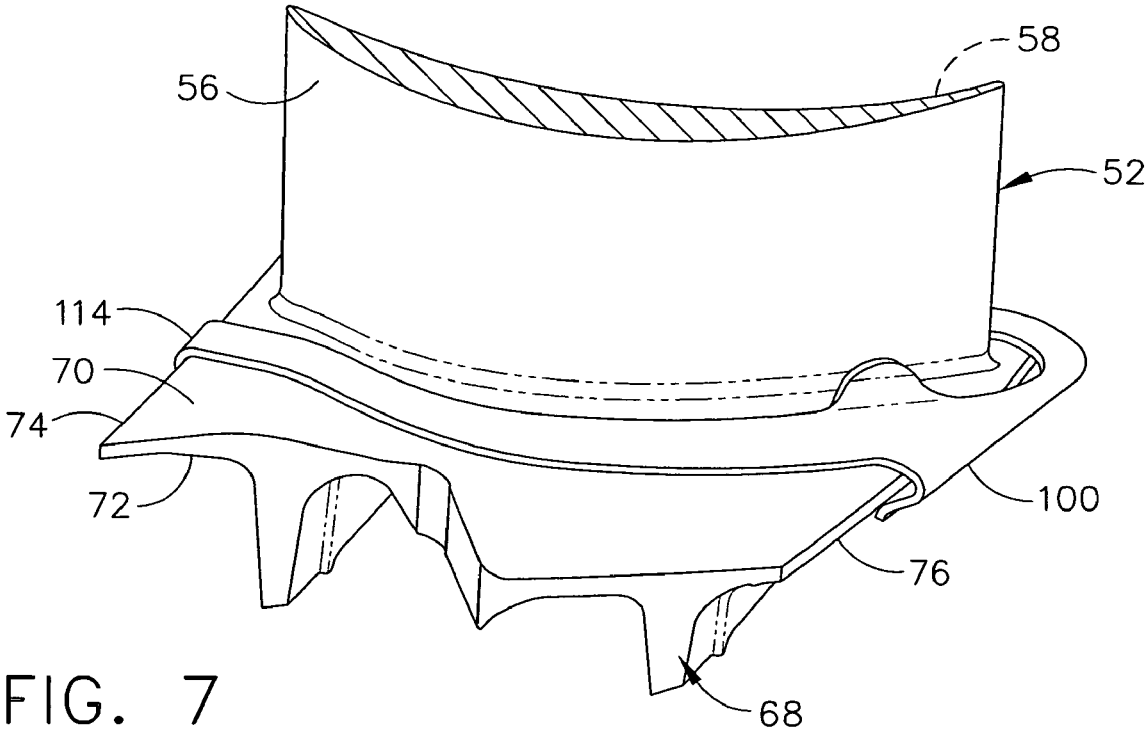
FIG. 7 is a top perspective view of the balance clip shown in FIG. 5 coupled to the rotor blade shown in FIG. 4.
Figure 8:
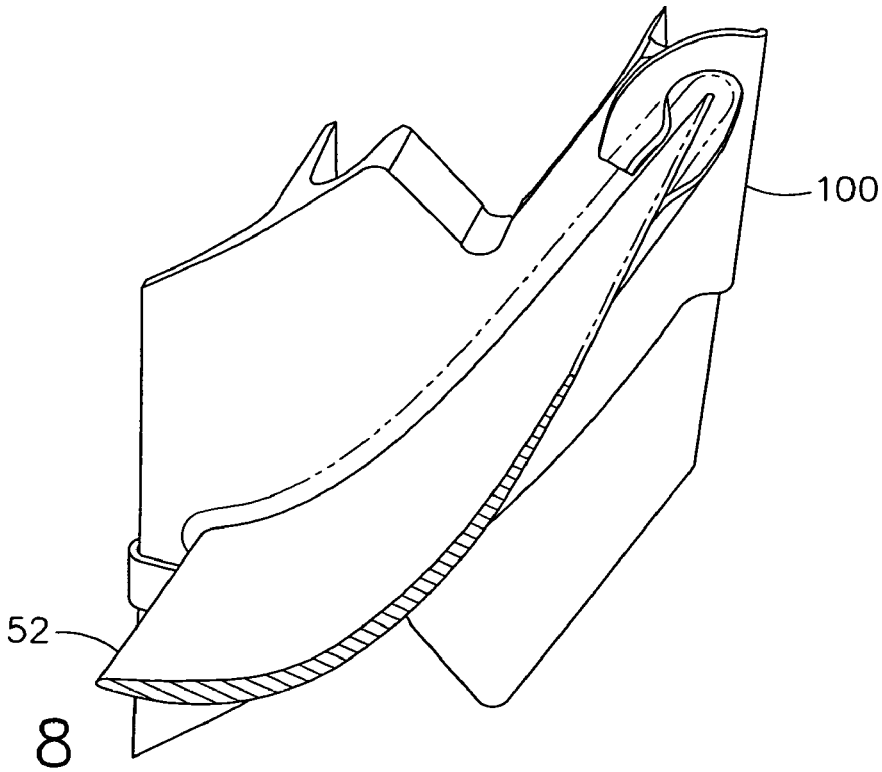
FIG. 8 is a bottom perspective view of the balance clip shown in 7.

FIG. 7 is a top perspective view of balance clip 100 shown in FIG. 5 coupled to rotor blade 50. FIG. 8 is a bottom perspective view of balance clip 100 coupled to rotor blade 50. During assembly, balance clip 100 is coupled to an exemplary turbine rotor blade. Although the invention is described with respect to the 5th stage turbine rotor blade used in an LM6000, it should be realized that the balance clip described herein can be used to balance any turbine rotor that includes at least one turbine rotor blade having a tip shroud. More specifically, first portion 102 is positioned adjacent tip shroud 68 such that first portion 102 is positioned adjacent first contoured sidewall 56 and second portion 106 is positioned adjacent second contoured sidewall 58. First hook 114 is then coupled to tip shroud 68 such that first hook 114 is coupled to leading edge 74. Second hook 118 is then coupled to tip shroud 68 such that second hook 118 is coupled to trailing edge 76. In the exemplary embodiment, a plurality of balance clips 100 are coupled to a plurality of turbine rotor blades 50 in the fifth stage 40 of low pressure turbine 20.

In operation, a plurality of balance clips 100 are coupled to rotor blades 50 in the fifth stage 40 of low pressure turbine 20, low pressure turbine 20 is then rotated at a sufficient speed to ensure that fifth stage 40 is properly balanced. During the balancing procedure, balance clips 100 are either coupled to/or removed from low pressure turbine 20 until the desired balance is achieved. Each balance clip 100 is then crimped, or forcibly squeezed, to facilitate permanently coupling balance clips 100 to turbine blades 50. More specifically, second hook 118 on each respective balance clip 100 is crimped to trailing edge 76 to facilitate securing balance clip 100 to each respective rotor blade 50.

In the exemplary embodiment, first hook 114 and second hook 118 are frictionally coupled to tip shroud 68 to facilitate restraining balance clip 100 axially on tip shroud 68, whereas first tab 110 and second tab 112 facilitate restraining balance clip 100 circumferentially and restrain balance clip 100 from "spinning" around airfoil 52.

The above-described method and apparatus for assembling a turbine rotor assembly are cost-effective and highly reliable to facilitate balancing the turbine rotor and to facilitate preventing engine failure that may be caused when known balance clips detach from a turbine rotor blade during engine operation. For example, since prior art balance clip includes three hooks, special tooling and training is required to couple the balance clip to the turbine rotor. However, since the balance clip described herein includes only two hooks, no special tooling or training is required to install the balance clip. As a result, the methods and apparatus described herein facilitate assembling and balancing a gas turbine rotor in a cost-effective and reliable manner.

An exemplary embodiment of a method and apparatus for balancing a gas turbine rotor is described above in detail. The balance clip is not limited to the specific embodiments described herein, but rather, the balance clip may be utilized independently and separately from other components described herein. For example, since the balance clip includes only two hooks, the balance clip may be installed on a variety of rotor blades that include a blade shroud.

While the invention has been described in terms of various specific embodiments, those skilled in the art will recognize that the invention can be practiced with modification within the spirit and scope of the claims.

What is claimed is:

1. A method for assembling a gas turbine rotor comprises:

providing a gas turbine rotor including a plurality of turbine blades, wherein at least one turbine blade includes a blade tip shroud that extends from a leading edge to an opposite trailing edge that is opposite the leading edge; and providing a balance clip including:

a first portion having a first length that enables the clip to extend between the tip shroud leading and trailing edges and includes a first hook that is configured to couple to the tip shroud leading edge;

a second portion having a second length that is shorter than the first length, such that the second portion extends only partially from one of the tip shroud trailing and leading edges towards the opposite shroud edge; and a second hook that extends between the first and second portions and is configured to couple to one of the tip shroud leading and trailing edges, wherein the first portion includes a first tab, and the second portion includes a second tab that extends from a free end of the second portion; and coupling the balance clip to the at least one turbine blade tip shroud such that the first and second tabs are positioned to retain the balance clip in position substantially circumferentially around an outer periphery of an airfoil extending from the tip shroud.

2. A method in accordance with claim 1 wherein coupling the balance clip to at least one turbine blade tip shroud further comprises coupling a balance clip including only two hooks to the at least one turbine blade tip shroud.

3. A method in accordance with claim 1 wherein coupling a balance clip to the at least one turbine blade tip shroud further comprises coupling a balance clip to a fifth stage rotor of the low pressure turbine.

4. A method in accordance with claim 1 wherein coupling the balance clip to the at least one turbine blade tip shroud further comprises forcibly squeezing the second hook to the blade tip shroud.

5. A method in accordance with claim 1 wherein coupling the balance clip to the at least one turbine blade tip shroud comprises coupling a substantially L-shaped balance clip to at least one turbine blade tip shroud.

6. A method in accordance with claim 1 further comprising coupling a plurality of balance clips to a plurality of turbine blade tip shrouds such that each respective balance clip is coupled to a respective turbine blade tip shroud.

7. A balance clip for a gas turbine rotor that includes a plurality of turbine blades, wherein at least one of the turbine blades includes a blade tip shroud that extends from a leading edge to an opposite trailing edge, said balance clip comprises:

a first portion having a first length that enables said balance clip to extend against the tip shroud and between the tip shroud leading and trailing edges and comprises a first hook that is configured to couple to said tip shroud leading edge;

a second portion having a second length that is shorter than said first length such that said second portion extends only partially from one of the tip shroud trailing and leading edges towards an opposite shroud edge; and a second hook that extends between said first and second portions for coupling said clip to at least one of said tip shroud leading and trailing edges, said first portion further comprises a first tab, said second portion comprises a second tab that extends from a free end of said second portion, said first and second tabs are configured to retain said balance clip in position substantially circumferentially around an outer periphery of an airfoil extending from the tip shroud.

8. A balance clip in accordance with claim 7 wherein said balance clip is coupled to a fifth stage rotor blade of a low pressure turbine using only said first and second hooks.

9. A balance clip in accordance with claim 7 wherein said second hook is forcibly squeezed to at least one of the tip shroud leading and trailing edges.

10. A balance clip in accordance with claim 7 wherein said balance clip further comprises a substantially L-shaped profile.

11. A balance clip in accordance with claim 7 wherein said first and second hooks are frictionally coupled to the tip shroud.

12. A gas turbine engine comprising:

a rotor assembly comprising a plurality of circumferentially-spaced rotor blades, at least one said rotor blade comprises a blade tip shroud that extends between a leading edge and an opposite trailing edge; and a balance clip coupled to said at least one rotor blade tip shroud, said balance clip comprises a first portion having a first length that enables said balance clip to extend adjacent said tip shroud and between said tip shroud leading and trailing edges, said first portion comprises a first hook that is configured to couple said clip to said tip shroud leading edge; and a second portion having a second length that is shorter than said first length, said second portion extends only partially from one of said tip shroud trailing and leading edges towards an opposite shroud edge, said first portion further comprises a first tab, said second portion comprises a second tab extending from said second portion, said first and second tabs are configured to retain said balance clip in position against the tip shroud and substantially circumferentially around an outer periphery of an airfoil extending from the tip shroud.

13. A gas turbine engine in accordance with claim 12 wherein said balance clip further comprises a second hook that extends between said first and second portions for coupling said clip to at least one of said tip shroud leading and trailing edges.

14. A gas turbine engine in accordance with claim 12 wherein said balance clip is coupled to said at least one rotor blade tip shroud using only said first and second hooks.

15. A gas turbine engine in accordance with claim 12 wherein said rotor assembly comprises a plurality of balance clips, each said balance clip coupled to a respective one of said rotor blade tip shrouds.

16. A gas turbine engine in accordance with claim 12 wherein said balance clip second hook is forcibly squeezed to at least one of said tip shroud leading and trailing edges.

17. A gas turbine engine in accordance with claim 12 wherein said balance clip comprises a substantially L-shaped profile.

18. A gas turbine engine in accordance with claim 12 wherein said balance clip first portion further comprises a first tab, said second portion comprises a second tab, said first and second tabs are configured to restrain said balance clip circumferentially around an outer periphery of an airfoil coupled to said at least one rotor blade tip shroud.

19. A gas turbine engine in accordance with claim 12 wherein said first and second hooks are frictionally coupled to said tip shroud.

* * * * *